United States Patent [19]

Morita et al.

[11] Patent Number: 4,787,944

[45] Date of Patent: Nov. 29, 1988

[54] PROCESS FOR PRODUCING SURFACE REMELTED CHILLED LAYER CAMSHAFT

[75] Inventors: Akiyoshi Morita, Nagoya; Hideo Nonoyama, Toyota; Toshiharu Fukuizumi, Toyota; Kiyokazu Uruno, Toyota, all of Japan

[73] Assignee: Toyota Jidosha Kabushiki Kaisha, Toyota, Japan

[21] Appl. No.: 129,349

[22] Filed: Nov. 30, 1987

Related U.S. Application Data

[63] Continuation of Ser. No. 894,829, Aug. 8, 1986, abandoned.

[30] Foreign Application Priority Data

Aug. 9, 1985 [JP] Japan ..... 60-174333

[51] Int. Cl.[4] ..... C21D 9/30

[52] U.S. Cl. ..... 148/152; 148/903; 148/904

[58] Field of Search ..... 148/152, 146, 4, 151, 148/13, 902, 903, 904, 145; 219/121 LM, 121 P, 121 EB, 121 R

[56] References Cited

U.S. PATENT DOCUMENTS

| | | | |
|---|---|---|---|
| 4,147,335 | 5/1979 | Heck | 266/261 |
| 4,312,685 | 1/1982 | Riedl | 148/152 |

FOREIGN PATENT DOCUMENTS

| | | |
|---|---|---|
| 0009563 | 4/1980 | European Pat. Off. . |
| 2703469 | 4/1979 | Fed. Rep. of Germany . |
| 53-94209 | 8/1978 | Japan . |
| 57-177926 | 11/1982 | Japan . |
| 59-23156 | 2/1984 | Japan . |
| 60-234168 | 11/1985 | Japan . |
| 60-234169 | 11/1985 | Japan . |

*Primary Examiner*—L. Dewayne Rutledge
*Assistant Examiner*—S. Kastler
*Attorney, Agent, or Firm*—Oblon, Fisher, Spivak, McClelland & Maier

[57] ABSTRACT

In a process for producing a surface remelted chilled layer camshaft by using a high density energy irradiation and self-cooling, a cam is rotated around the center axis of the camshaft and a position of a torch for the irradiation (e.g., a TIG arc torch) is controlled so as to form an angle between a tangential line of the cam surface and a horizontal line at a melting position in a lower side of the horizontal line in a direction opposite to the camshaft rotation direction being from 30°, preferably 20°, to zero degree.

7 Claims, 7 Drawing Sheets

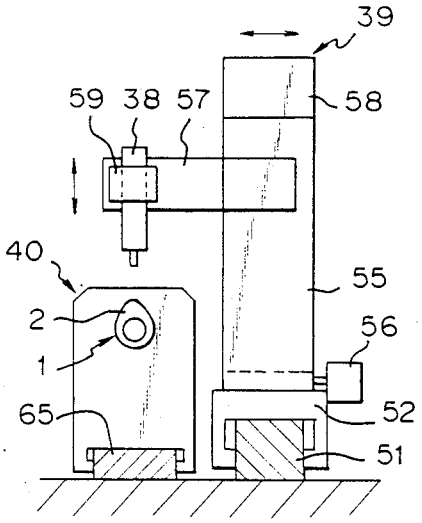
Fig. 7
Fig. 8
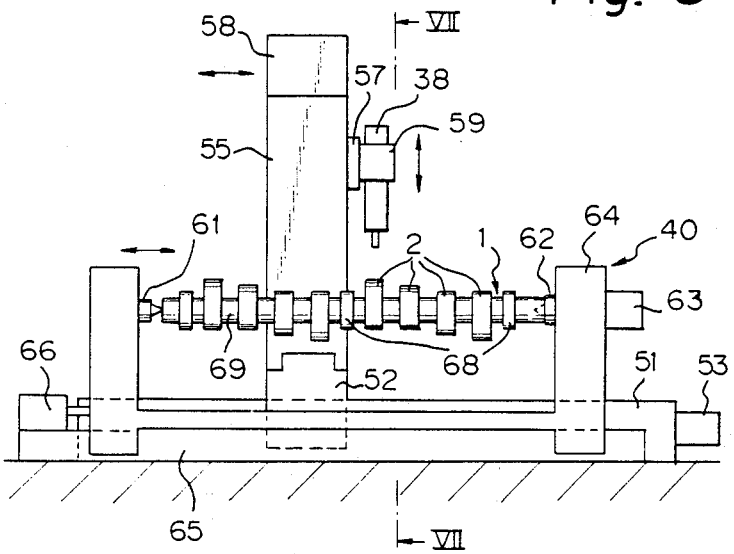

(a) (b)

PROCESS FOR PRODUCING SURFACE REMELTED CHILLED LAYER CAMSHAFT

This application is a continuation of application Ser. No. 894,829, filed on Aug. 8, 1986, now abandoned.

BACKGROUND OF THE INVENTION

1. Field of the Invention

The present invention relates to a camshaft with cams. More particularly, it relates to a process for producing a surface remelted and chilled layer camshaft having an excellent wear-resistant chill layer formed by melting a sliding cam surface with a high density energy, such as a TIG arc, a laser beam, a plasma arc, or an electron beam, and chilling the molten portion by self-cooling.

2. Description of the Related Art

In a camshaft with cams fitted into an engine for an automobile and the like, a sliding cam surface of each of the cams must have a superior wear-resistance. Accordingly, the cam is subjected to a surface remelting treatment (i.e., surface hardening treatment) in which the sliding cam surface portion is melted by a high density energy, such as a TIG arc, a laser beam, or an electron beam, and is rapidly cooled by self-cooling to form a chill hardened layer (for example, cf. Japanese Unexamined Patent Publication (Kokai) Nos. 59-23156, 60-234168, and 60-234169 filed by the present applicant). When the surface remelted chilled layer camshaft is produced by using this surface hardening treatment, as shown in FIG. 1, a TIG arc 5 is generated between a cam 2 of a camshaft 1 and a tungsten electrode 4 of a TIG torch 3 to melt a sliding cam surface, and simultaneously, the camshaft 1 is rotated around its center axis 6 in a direction 7 and is oscillated (reciprocated) in a direction 8 which is parallel to the center axis 6. The torch 3 is moved in a vertical direction 9, with a constant distance (gap) being maintained between the tungsten electrode 4 and the surface of the cam 2. Note, the torch 3 can be oscillated instead of the camshaft 1.

FIG. 2 shows a cross section of the cam 2 of the camshaft 1, with the axis (Z-axis) 11 of the torch 3 intersecting the center axis 6 of the camshaft 1. At a melting point A, a tangential line 12 of a cam profile and the horizontal line 13 form a varying angle $\alpha$ (referred to as a sag angle). The sag angle varies in the lower left side (FIG. 2) and in the lower right side (not shown) to the horizontal line as the border of the nose point. When the sag angle $\alpha$ is large, a problem arises in that a molten metal pool formed by a high density energy is caused to sag downward by the force of gravity. Generally, the sag angle $\alpha$ is at a maximum when an angle formed between the axis 11 of the torch 3 and a line connecting the cam nose point 14 to the center axis 6 of the camshaft 1 is from 15° to 30° (degrees). This maximum angle is formed at both sides of the cam nose point 14. One of these two positions will have the maximum sag angle during the melting by the TIG arc on a cam surface portion from a base circle portion 15 of the cam 2 to the cam nose point 14 (in FIG. 2). In this case, under the melting position, a chill layer was formed by melting and then rapidly cooled by self-cooling, accordingly the chill layer retains a certain heat. This heat delays the solidification of a portion of the molten pool that is sagging due to the force of gravity. An arc will generate preferentially between a hot spot which was melted and solidified and the tungsten electrode, so that an arc column shifts downward from a line connecting the electrode and the center axis of the camshaft to the chill layer previously formed. The faster the rotational speed of the camshaft, the larger the shift of the arc column. A portion of an argon gas stream enclosing the arc column shifted from the line flows downward along the cam surface. Furthermore, when the camshaft is rotated, a center portion of a molten metal pool is apt to flow in the rotation direction under the influence of the angular velocity. Therefore the above-mentioned factors increase the sagging of the molten metal pool. On the other hand, at the other position having the maximum sag angle during the melting by the TIG arc on a cam surface portion from the cam nose point 14 to the base circle portion 15, the sagging does not cause a problem. In this case, if the molten metal pool is caused to sag by the force of gravity, the sagging portion rapidly solidifies, since a portion of the cam under the melting position is still not heated and is cool. The arc column is shifted upward to the chill layer previously formed and continuing from the cam nose point 14, and a portion of the argon gas stream enclosing the shifted arc column flows upward along the cam surface. Therefore, the influences of the heat and argon gas stream explained in the former case do not occur, so that the sagging does not increase.

Where a large sagging of the molten metal pool occurs, as shown in FIG. 3 which is a partial cross-sectional view of a cam taken along the center axis 6, an irregularity occurs on a cam surface (i.e., a surface of a chill layer 21). In FIG. 3, a martensite layer 22 is formed under the chill layer 21, and a matrix structure of the cam (an as-cast structure) 23 exists under the layer 22. After the surface remelting treatment using a TIG arc, the surface remelted chilled layer camshaft is subjected to grinding treatment so as to form ground surfaces of cams having a predetermined profile. When a cam with large irregular surface is ground, at a recess 24 deeper than a grinding margin t, a portion of the skin remains. Generally the grinding margin t is a difference between the treated cam surface and the ground surface 27, e.g., about 0.5 mm. In practice, the grinding margin varies in accordance with the capability of a machine tool prior to the surface hardening treatment. Taking the variation into consideration, in order to eliminate the defect of the remaining skin portion, it is necessary to make a depth of the recess in the treated cam surface to be within 0.25 mm from the cam surface 26. In order to ensure the depth of less than 0.25 mm in the recess caused by the sagging of the molten metal pool, when the sag angle $\alpha$ is 33°, an arc current is decreased (the irradiation energy is decreased) to decrease the amount of the molten metal pool, whereby a maximum chill depth becomes from 0.8 to 1.0 mm. However, the chill layer having the maximum chill depth of that value is likely to became unstable, even though the wear resistance of the chill layer is such that it passes various durability tests using an engine. Preferably, the maximum chill depth is more than 1.0 mm, more preferably, more than 1.5 mm.

In order to ensure such a large maximum chill depth (chill layer thickness), the surface hardening treatment (remelting chilling treatment) on the cam surface must be carried out by using a predetermined energy controlled to ensure that the sagging of the molten metal pool due to the force of gravity is reduced.

A proposal has been made that a sag angle $\alpha$ be constantly kept at 0° (zero degree), to minimize or prevent sagging of the molten metal pool due to the force of gravity. For example, according to a method for hardening a sliding cam surface disclosed in Japanese Unexamined Patent Publication (Kokai) No. 57-177926, a sliding cam surface portion including a nose portion between B to E in FIGS. 1 to 3 is always kept in a horizontal position (a sag angle $\alpha$ being approximately equal to zero). An apparatus for carrying out the proposed method requires a mechanism for eccentrically rotating a camshaft around a center axis of a small circle of the nose portion, and a mechanism for transferring a torch in a direction at right-angles to the center axis of the camshaft. In recent years, to prevent abnormal wear at a base circle portion of the cam, the remelting chilling treatment is applied on the whole circumferential surface of the cam. However the apparatus is not provided with a mechanism for treating a base circle portion of the cam. If the remelting chilling treatment for carried, the base circle portion is the camshaft is rotated around a center axis of a large circle of the base circle portion (the center axis corresponding to the camshaft center axis), so that the apparatus is very complicated.

Another proposal for decreasing the sagging of the molten metal pool due to the force of gravity has been made, wherein the torch is shifted in a direction opposite to the rotation direction from the vertical line passing the camshaft center axis 6, so as to form the sag angle in the lower right side only. This shifting of the torch is disclosed in Japanese Unexamined Patent Publication No. 53-94209, based on DE patent application No. 2703469.1. As shown in FIG. 1 of this Japanese Patent publication, the torch is arranged at an angle of 45° from the vertical line passing the camshaft center axis in the opposite direction to the rotation direction. In this case, the sag angle is formed between the horizontal line and the tangential line of the cam profile, downward in the right side of the vertical line, as shown FIGS. 4*a* to 4*f* and 5*a* to 5*f* attached. In FIGS. 4*a* to 4*f*, the torch 3 is shifted in a direction opposite to the camshaft rotation direction and is arranged in such a manner that the axis of the torch 3 passes the camshaft center 6 and forms a constant angle of 45° with the vertical line 11 (in the Z-direction). The remelting of the TIG arc is carried out, as shown in FIGS. 4*a* to 4*f*, while maintaining the formation of the sag angle within the lower right side to the horizontal line. Furthermore, in FIGS. 5*a* to 5*f*, the torch 3 is arranged in another manner such that the torch axis 3 forms an constant angle of 45° with the vertical line 11 and intersects the vertical line 11 above the camshaft center 6. The remelting of the TIG arc is carried out, as shown in FIGS. 5*a* to 5*f*, while maintaining the formation of the sag angle smaller than that of FIGS. 4*a* to 4*f* within the lower right side. In these cases, however, since the variation of the sag angle is relatively large, arc generating spots also largely vary and a shield of an argon gas becomes irregular. Thus, the electrode of the torch is oxidized and must be discarded, so that the arc generating stops are continuously shifted from appointed positions. As a result, defects such as melt-down end portion defects and the defect of the remaining skin portion frequently occur during operation. Therefore, the frequency of electrode exchange increases, which involves an increase in the electrode costs, grinding of electrode, and an increase of exchange steps.

SUMMARY OF THE INVENTION

An object of the present invention is to provide a method for reducing the sagging of the molten metal pool caused by the force of gravity in a process of the remelting chilling treatment using an irradiation of a high density energy, which method is different from the above-mentioned proposed methods and has larger degrees of freedom than those of the proposed methods.

Another object of the present invention is to provide a process for producing a surface remelted chilled layer camshaft, which process makes a depth of a recess caused by the sagging of the molten metal pool less than 0.25 mm and ensures a maximum chill depth of more than 1.0 mm in a cross section taken in the cam width direction on the whole circumferential surface of the cam.

These and other objects of the present invention are attained by a process for producing a camshaft with cams subjected to a remelting chilling treatment comprising steps of melting a sliding cam surface of each of the cams by irradiating a high density energy, and forming a continuous chill layer by self-cooling, which process is characterized in that the cam is rotated around the center axis of the camshaft, and a position of a torch for irradiating the high density energy is held at the sliding cam surface so as to form an angle between a tangential line of the cam surface and a horizontal line at a melting position in a lower side of the horizontal line in a direction opposite to the camshaft rotation direction, which angle is from 30°, preferably 20°, to 0° (zero degree), so that sagging of a molten metal pool caused by the force of gravity is reduced.

The position control of the torch is carried out in so-called contour control manner by transferring the torch in at least two directions of a horizontal Y-axis direction perpendicular to a center axis direction of the camshaft and of a vertical Z-axis direction perpendicular to the center axis direction.

When the high density energy is a TIG arc, the position control of the torch is carried out so as to maintain a constant shortest gap between the torch and the cam surface to be treated.

BRIEF DESCRIPTION OF THE DRAWINGS

The present invention will become more apparent from the description of the preferred embodiments set forth below with reference to the accompanying drawings, in which:

FIG. 7 is a sectional side view of a mechanical portion of the apparatus for the remelting and chilling treatment, taken along the line VII—VII of FIG. 8;

FIG. 8 is a front view of the mechanical portion of the apparatus for the remelting and chilling treatment;

DESCRIPTION OF THE PREFERRED EMBODIMENTS

Figure 1:
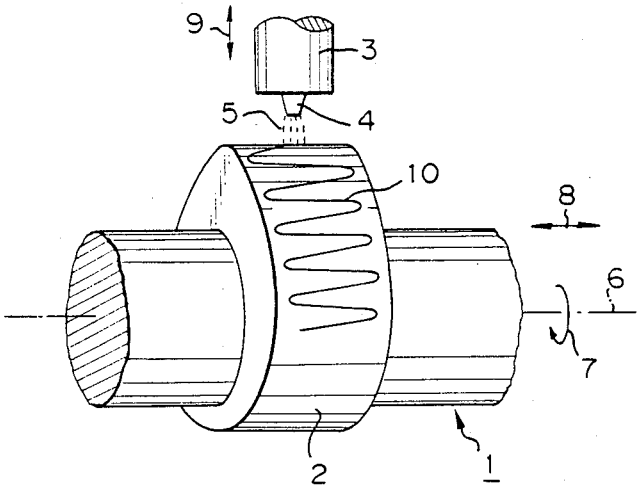
FIG. 1 is a schematic view of a cam of a camshaft and a TIG arc torch.
Figure 2:
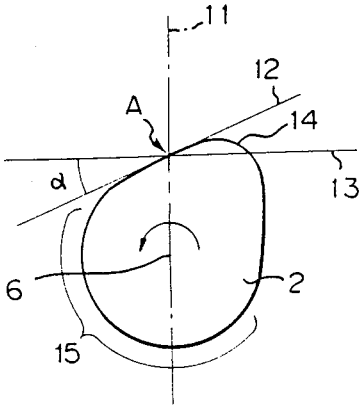
Fig. 2 PRIOR ART
FIG. 2 is a schematic sectional view of a cam, illustrating a sag angle $\alpha$ formed in accordance with the prior art.
Figure 3:
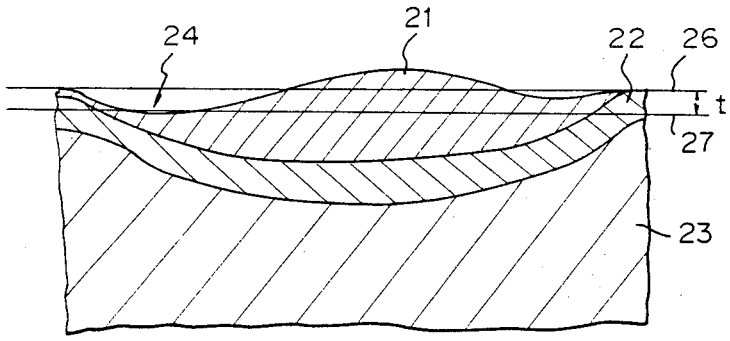
Fig. 3 PRIOR ART
FIG. 3 is a sectional partial view of a cam having an irregular surface caused by the sagging of a molten metal pool.
Figure 6:
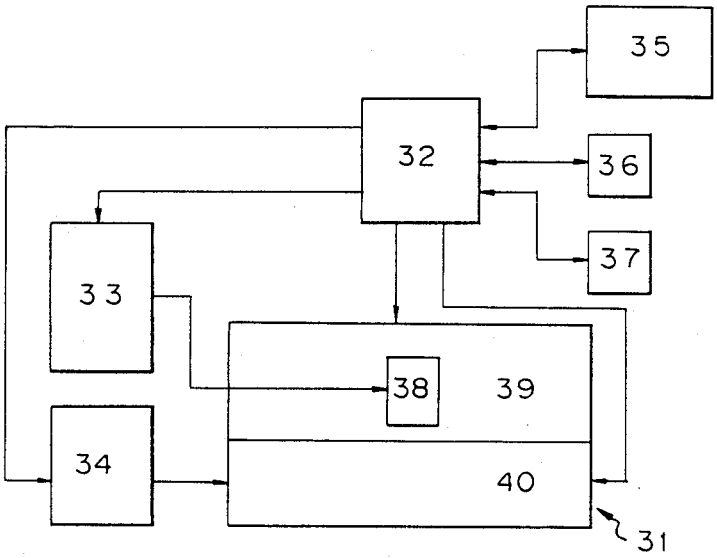
FIG. 6 is a block diagram of a control system of an apparatus for the remelting and chilling treatment.
Figure 4:
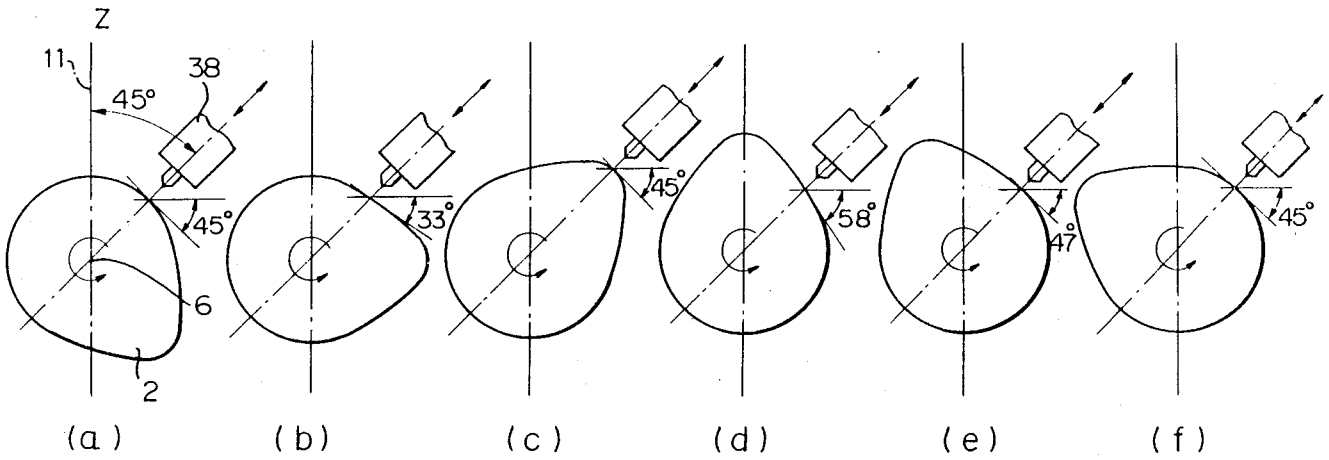
Fig. 4 PRIOR ART
FIGS. 4*a* to 4*f* are schematic views of a cam and a TIG arc torch in various positions during the remelting chilling treatment according to the prior art.
Figure 5:
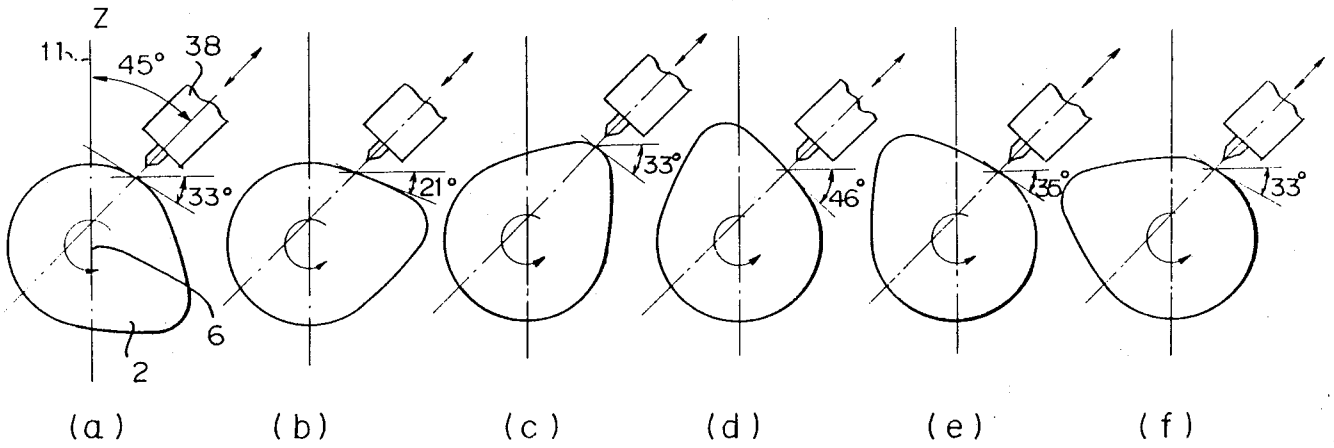
Fig. 5 PRIOR ART
FIGS. 5*a* to 5*f* are schematic views of a cam and a TIG arc torch in various position during the remelting chilling treatment according to another prior art.

Referring to FIGS. 6, 7 and 8, an apparatus for carrying out the process for producing a surface remelted and chilled layer camshaft according to the present invention will be now explained. A control system of the apparatus is shown in FIG. 6. A mechanical portion of the apparatus is shown in FIGS. 7 and 8.

The apparatus of the remelting and chilling treatment comprises a control unit and the mechanical portion (unit) 31. The control unit comprises a controller 32, a high density energy source (an electric source for a TIG arc) 33, a control device 34 for oscillation of the camshaft a programming unit 35, a teaching unit 36, and an operating board 37. The mechanical portion 31 comprises, a high density energy irradiator (TIG torch) 38, a robot portion 39 for moving the torch in the directions of the X-axis, Y-axis and Z-axis intersecting each other at right angles, and a driving portion 40 for carrying, rotating, and oscillating a camshaft. In this example the camshaft is oscillated, but the torch can be oscillated instead of the camshaft.

The electric source 33 for the TIG arc preferably feeds a melting current for a direct current TIG arc which is periodically varied and has a wave-form similar to a current wave-form in so-called TIG pulse welding. This pulse current has a base current (background current) which can generate a TIG arc for melting a cam surface so that a molten metal pool is continuously formed. Preferably, the melting current has a base current of from 60 to 140 A, to obtain a maximum chill depth of more than 1.0 mm. If the base current is more than 140 A, the melt quantity is large and brings about the problem of sagging. Preferably a peak value and a pulse width of the pulse current are suitably set to from 70 to 150 A and from 0.1 to 0.4 seconds, respectively.

The robot portion 39 having three moving directions along the X-axis, Y-axis and Z-axis intersecting each other at right angles comprises a slide base 51, a slider 52, and a drive 53 for the slider 52, which transfers a torch 38 in an X-axis direction parallel to the center axis 6 of a camshaft 1. To transfer the torch 38 in a horizontal Y-axis direction perpendicular (at right angles) to the camshaft center axis direction, another slider 55 and a drive 56 for the slider 55 are set on the X-axis direction slider 52. Furthermore, to transfer the torch 38 in a vertical Z-axis direction perpendicular (at right angles) to the center axis direction, the Y-axis direction slider 55 is provided with a vertically movable plate 57, a fixture 59 for attaching the torch 38 to the movable plate 59, and a movable plate drive 58. The driving portion 40 for a workpiece (camshaft) comprises a rotating portion 64, a slide base 65, and an oscillating drive 66. The rotating portion 64 has centers 61 and 62 holding the camshaft 1 and a drive (servomotor) 63 for rotating the camshaft. The oscillating drive 66 oscillates (reciprocates) the rotating portion 64 in the X-axis direction on the slide base 65. Certain commands are transmitted from the controller 32 to the drives 53, 56, 58, 63, and 66, and the electric source 33. In order to carry out the remelting chilling treatment for the camshaft in accordance with the process of the present invention, optimum operating conditions are set up by means of the programming unit 35, the teaching unit 36, and the operating board 37, and accordingly, the treatment apparatus is automatically operated by the controller 32.

By using the above-mentioned remelting chilling treatment apparatus, a camshaft 1 is rotated and a TIG arc torch 38 is transferred, as shown in FIGS. 9*a* to 9*e*, so as to form a continuous chill layer by melting a cam surface with the TIG arc and by self-cooling, to produce a camshaft.

First the camshaft 1 is set between the centers 61 and 62 of the rotation portion 40, as shown in FIG. 8. The camshaft 1 comprises cams 2, bearing journal 68, and a shaft body 69 and is made of, e.g., special cast iron. The camshaft 1 is machined to have, for example, the following dimensions:

Total camshaft length: 400 mm
Cam width: 14.4 mm
Diameter of base circle portion: 31 mm
Lifting height: 8 mm A profile of the cam 2 (FIGS. 9*a* to 9*e*) comprises a base circle portion from point E to point B via points F and A, a nose portion (an eccentric circle portion having a small diameter) from point C to point D, and two linear portions from point B to point C and from point D to point E smoothly connecting the circle portions. When generating the TIG arc, it is necessary to maintain a constant shortest distance (gap) between the cam surface and a tungsten electrode of the torch 38, and accordingly, the shape of a master cam is premeasured by means of a sensor (using a ball with 4 mm diameter) and an electromagnetic micrometer, and the position variation of the torch is suitably set by the teaching unit 35 in connection with the rotation of the camshaft 1. The cam profile and position variation are stored in the memory of the program unit 36. A motion of transferring the robot portion 39 in the X-axis direction is also programmed, so as to treat the next cam after the finish of the remelting chilling treatment for the preceding cam.

Figure 9:
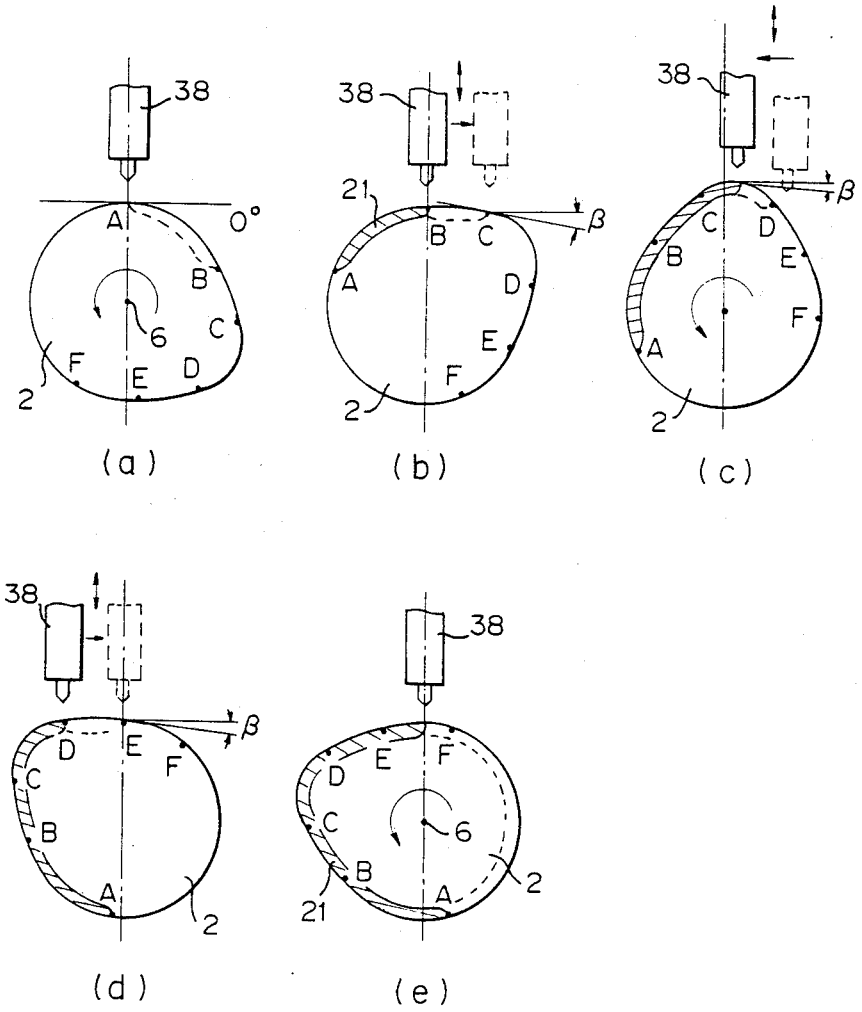
FIGS. 9*a* to 9*e* are schematic views of a cam and a TIG arc torch in various positions during the remelting chilling treatment according to an embodiment of the process of the present invention.

As shown in FIG. 9*a*, the torch 38 is brought on the vertical line passing the camshaft axis 6. The point A (a starting point) corresponding to the torch 38 is an optional point on the cam base circle portion. It is preferable to determine the point A as over +45° from an extension line passing the nose point and the center axis 6. In this state, the TIG arc is generated between the torch 38 and the cam surface, and the camshaft 1 is oscillated in the camshaft center 6 direction (i.e., X-axis direction) with an oscillation width (amplitude) of 9.5 mm at a cycle of 1.1 seconds (i.e., 1.1 seconds per cycle). The camshaft 1 is not rotated for three seconds from the arc generation, and then is rotated at a rotation speed of 300°/min. This nonrotational time is a preheating time, since if the cool camshaft is not preheated a shallow melting depth and a thin chill layer will result, and thermal stress will occur which may cause cracking. If the camshaft can be preheated by a heating method of passing an electric current therethrough, and the like, the camshaft is rotated without the nonrotation time. The TIG arc current for melting is set under the following conditions:

Base current: 115 A
Pulsed peak current: 125 A
Pulse duration: 0.2 seconds

Thus the portion of the cam surface from point A to point B is subjected to the remelting chilling treatment by using the TIG arc having an arc length of 2.0 mm, corresponding to a tangential line of the cam surface and the horizontal line at a melting point. The tangential line and the horizontal line do not form an angle, i.e., zero degree.

As shown in FIG. 9*b*, when point B comes under the torch 38, the camshaft rotation is stopped. Then, while maintaining the arc length of 2.0 mm, the torch 38 is transferred to point C along the linear portion from point B to point C in almost a horizontal position in the Y-axis direction. Preferably the tangential line of the linear portion extends in the lower right side to the horizontal line (in FIG. 9*b*) in a direction opposite to the camshaft rotation direction, more preferably, an angle $\beta$ formed between the tangential line and the horizontal line is close to zero. It is possible to make the angle $\beta$ zero. The transfer of the torch 38 is carried out by moving the Y-axis direction slider 55 (FIG. 7) in the Y-axis direction by means of the drive 56 and by moving the movable plate 57 with the torch in the vertical (Z-axis) direction by means of the movable plate drive 58, in accordance with the linear portion. In this portion, the torch 38 is transferred at a speed of 100 mm/min and the melting level current is intensified to the base current of 120 A and the pulsed peak current of 130 A (pulse duration unchanged). This intensity of the TIG arc current is to ensure a sufficient chill layer by increasing the chill depth (chill layer thickness), although an irregularity of the dimensions of the cam has occurred in the previous rough machining step for the cam profile.

Next, when the torch 38 reaches a point B just thereabove, the camshaft is rotated, as shown in FIG. 9*c*, at a rotation speed of 300°/min, and simultaneously, the torch 38 is transferred along the Y-axis direction to a left side in the drawing, and along the Z-axis direction so as to maintain the arc length of 2.0 mm. Thus, the nose portion from point C to point D is subjected to the remelting chilling treatment under a condition such that the tangential line at the melting point extends in the lower right side relative to the horizontal line. In this portion, since the heat of the TIG arc is concentrated in the nose portion to affect the rapid self-cooling, the melting level current is decreased to the base current of 100 A and the pulsed peak current of 110 A (pulse duration unchanged). When the melting point reaches point D, the torch 38 and cam 2 located as shown in FIG. 9*d*.

When the situation as shown in FIG. 9*d* exists, the camshaft rotation is stopped. Then, maintaining the arc length of 2.0 mm, the torch 38 is transferred to point E (on the vertical line passing the camshaft center 6) along the linear portion in almost a horizontal position. In this case, the conditions are similar to those shown in FIG. 9*b*, except that the base current is 110 A and the pulsed peak current is 120 A.

When the torch 38 reaches a point just above point E, as shown in FIG. 9*e*, the camshaft 1 is rotated at a speed of 300°/min. Since the portion from point E to point A is to base circle portion, it is unnecessary to transfer the torch 38, and the tangential line of the cam surface at the melting position corresponds to the horizontal line (i.e., the sag angle is zero). If the whole base circle portion need not be subjected to the remelting chilling treatment, the treatment can be carried out to an optional point F.

The above-mentioned remelting chilling treatment using the TIG arc does not involve a slanting portion of the cam profile or the sag angle causing the sagging of the molten metal pool, and accordingly, a recess having a depth of more than 0.5 mm does not appear and thus no defect of the remaining skin portion exists after grinding. According to the inspection of the chill layer thickness in a cross section of the treated cam, the maximum chill depth is from 1.5 to 1.7 mm. A portion of the cam surface from point B to point C, which is subjected to a strong pressure, has a chill layer depth of from 1.5 to 1.7 mm.

Figure 10:
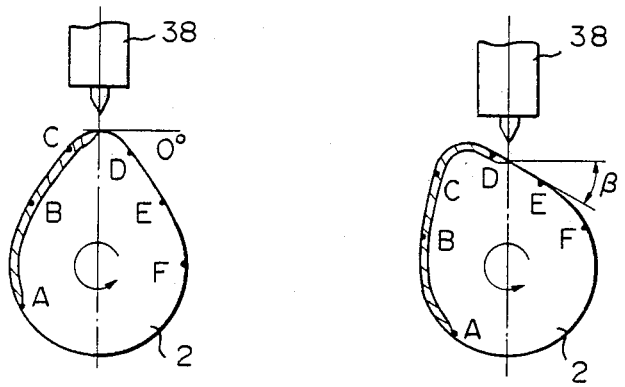
FIGS. 10*a* and 10*b* are schematic views of a cam and a TIG arc touch in intermediate positions during the remelting chilling treatment according another embodiment of the process of the present invention.

In the above embodiment, the torch 38 moves beyond the vertical line passing the camshaft center 6 from the right side position of FIG. 9*c* to the left side position of FIG. 9*d* during the treatment for the cam surface portion from point C to point E. On the other hand, it is possible to carry out the remelting chilling treatment through conditions shown in FIGS. 10*a* and 10*b* instead of the condition of FIG. 9*d*, from the condition of FIG. 9*c* to the condition of FIG. 9*e*. In FIG. 10*b*, the sag angle $\beta$ can be formed at about 30°, depending on, e.g., cam dimensions, but the sagging of the molten metal pool is not so large that the sagging caused by the force of gravity brings about a problem. If the sag angle is more than 30°, the behavior of the TIG arc is not correctly controlled and the service life of an electrode of the TIG arc torch becomes shorter. Taking such the demerits into consideration, it is preferable that the sag angle in a lower side of the horizontal line in a direction opposite to the camshaft rotation direction is less than 20°.

As mentioned above, the process for producing a surface remelted chilled layer camshaft by using the TIG arc according to the present invention can reduce the sagging of the molten metal pool caused by the force of gravity and increase the maximum chill depth.

It will be obvious that the present invention is not restricted to the above-mentioned embodiment and that many variations are possible for persons skilled in the art without departing from the scope of the invention. For example, the TIG arc is used as an every source in the embodiment, but a laser beam, a plasma arc, or an electron beam can be used for producing the remelted and chilled camshaft in accordance with the present invention.

We claim:

1. A process for producing a surface remelted chilled layer camshaft, comprising the steps of:

controlling a rotation of a camshaft such that a cam thereof rotates about the center axis of said camshaft;

relatively oscillating one of a torch and said cam in the direction of said center axis;

irradiating a sliding surface of said cam with high density energy from said torch so as to melt a portion of said sliding surface at a melting position;

controlling a position of said torch in two transfer directions, said transfer directions comprising a horizontal Y-axis direction perpendicular to a center axis direction of said camshaft and a vertical Z-axis direction perpendicular to said center axis direction, such that a portion of a tangent to said sliding surface at said melting position, said portion of said tangent extending upstream from said melting position as measured in said rotation direction and extending below a horizontal line passing through said melting position, forms an angle of between 0° and 30° with the horizontal line, said angle being non-zero when said melting position is at a nose portion of said cam; and permitting a melted portion of said sliding surface to cool, whereby a chill layer is formed.

2. A process according to claim 1, wherein said control step is repeated for each cam of said camshaft.

3. A process according to claim 1, wherein said cam is oscillated.

4. A process according to claim 1, wherein said camshaft is rotated during irradiation of a base circle portion and a nose portion of said sliding cam surface.

5. A process according to claim 1, wherein said high density energy is one of a TIG arc, a laser beam, a plasma arc and an electron beam.

6. A process according to claim 1, wherein said high density energy is a TIG arc and said torch is controlled to maintain a constant short gap between said torch and said cam surface.

7. A process according to claim 1 wherein said angle varies between 0° and 20°.

* * * * *